US005816532A

United States Patent [19]

Zasadny et al.

[11] Patent Number: 5,816,532

[45] Date of Patent: Oct. 6, 1998

[54] MULTIPOSITION FOLDING CONTROL SURFACE FOR IMPROVED LAUNCH STABILITY IN MISSILES

[75] Inventors: Philip J. Zasadny, Los Alamitos; William A. Moore, Rancho Palos Verdes; Alf Marrin, San Pedro, all of Calif.

[73] Assignee: Northrop Grumman Corporation, Los Angeles, Calif.

[21] Appl. No.: 769,032

[22] Filed: Dec. 17, 1996

[51] Int. Cl.[6] ..... F42B 10/20

[52] U.S. Cl. ..... 244/3.29

[58] Field of Search ..... 244/3.29, 3.28, 244/3.27, 49

[56] References Cited

U.S. PATENT DOCUMENTS

| | | | |
|---|---|---|---|
| 3,125,956 | 3/1964 | Kongelbeck . | |
| 3,563,495 | 2/1971 | Korn | 244/3.29 |
| 3,650,496 | 3/1972 | Svensson | 244/3.29 |
| 3,711,040 | 1/1973 | Carver | 244/3.21 |
| 4,530,476 | 7/1985 | Thurber, Jr. et al. | 244/3.21 |
| 4,588,146 | 5/1986 | Schaeffel, Jr. et al. | 244/3.27 |
| 4,659,038 | 4/1987 | Hoeppner et al. | 244/49 |
| 4,691,880 | 9/1987 | Frank | 244/49 |
| 4,709,877 | 12/1987 | Goulding | 244/3.28 |
| 4,717,093 | 1/1988 | Rosenberger et al. | 244/49 |
| 4,778,127 | 10/1988 | Duchesneau | 244/3.29 |
| 4,844,380 | 7/1989 | Peoples et al. | 244/3.22 |
| 4,884,766 | 12/1989 | Steinmetz et al. | 244/3.27 |
| 5,085,381 | 2/1992 | Spiroff et al. | 244/3.24 |
| 5,356,094 | 10/1994 | Sylvain | 244/49 |
| 5,671,899 | 9/1997 | Nicholas et al. | 244/49 |

FOREIGN PATENT DOCUMENTS

| | | | |
|---|---|---|---|
| 26 49 643 | 6/1978 | Germany . | |
| 2121147 | 12/1983 | United Kingdom | 244/3.29 |

*Primary Examiner*—Charles T. Jordan
*Assistant Examiner*—Christopher K. Montgomery
*Attorney, Agent, or Firm*—Terry J. Anderson; Karl J. Hoch, Jr.

[57] ABSTRACT

A multiposition folding control surface for missiles designed to provide improved launch stability therefor. The control surface can be folded in one of two positions depending upon size and stability requirements, a first folded position for compact carriage with minimal stability requirements, and a second folded position for a less compact carriage with added stability requirements. The multiposition folding control surface comprises a spindle fitting which is attached to the missile, and which is rotatably controlled by a flight control actuator. A center fitting is hingedly attached to the spindle fitting, and provides a nonactuated folding of the center fitting to accommodate more compact missile storage in a shipping container. An actuator housing is hingedly attached to the center fitting, and provides the major aerodynamic surfaces for the control surface. An actuated hinged linkage is attached to the actuator housing, and has an anchor link, one end of which can be attached by a release pin to either the center fitting to provide the first folded position, or the actuator housing to provide the second folded position, depending upon which of the first and second fold positions is selected. A power actuator is provided for powering the actuated hinged linkage, and uses the same power stroke to deploy the actuator housing from either of the first or second folded positions to a fully deployed and extended flight position.

10 Claims, 4 Drawing Sheets

MULTIPOSITION FOLDING CONTROL SURFACE FOR IMPROVED LAUNCH STABILITY IN MISSILES

BACKGROUND OF THE INVENTION

1. Field of the Invention

The present invention relates generally to a multiposition folding control surface providing improved launch stability for missiles, and more particularly pertains to a multiposition folding control surface for missiles designed to provide improved launch stability therefor which can be folded in one of two positions to optimize both the missile size and its launch stability. The present invention uses a linkage which allows the missile control surface to be folded in one of two positions depending upon size and stability requirements. A first position is for a compact carriage with minimal stability requirements, and a second position is for a less compact carriage with added stability requirements.

2. Discussion of the Prior Art

In many present day air launched guided missiles, control surfaces on the missiles are folded to minimize the missile size, both for storage purposes and so that a maximum number of guided missiles can be carried by an aircraft. Folding control surfaces on air launched missiles often cause the missile to be unstable during the launch and or jettison. Folding these control surfaces reduces the missile's flight stability at launch and or jettison by reducing the distance between the missile's center of gravity and it's center of lift. As the center of gravity and the center of lift converge, the missile becomes more unstable and may not safely separate from the carriage aircraft. In many designs, the distance between these two points is allowed to vary depending upon the carriage aircraft and launch conditions. Classically there have been two design approaches. A first approach is to design a single jettisonable device which will satisfy the stability requirements but may not satisfy volumetric constraints. A second approach is to design several jettisonable devices which satisfy both constraints. Both approaches add additional weight and cost to the missile. The present invention offers a mulitposition folding control surface which satisfies both requirements. For carriage aircraft with harsh launch conditions, a larger tail span is available for additional control and stability, and for carriage aircraft with more benign launch conditions a smaller tail span can be used.

SUMMARY OF THE INVENTION

Accordingly, it is a primary object of the present invention to provide a multiposition folding control surface for missiles designed to provide improved launch stability therefor.

A further object of the subject invention is the provision of a multiposition folding control surface providing for improved launch stability, and which allows a guided missile flight control surface to be folded in one of two positions using a single actuator with the same stroke for either position. The present invention utilizes a standard pyrotechnic linear actuator which is attached to a linkage which can be easily reconfigured to either one of two linkage positions. The subject invention allows the control surface to be folded in one of two positions depending upon the type of carriage aircraft the missile will be deployed on and the prevailing launch conditions.

In accordance with the teachings herein, the present invention provides a multiposition folding control surface for missiles designed to provide improved launch stability therefor. The control surface can be folded in one of two positions depending upon size and stability requirements, a first folded position for compact carriage with minimal stability requirements, and a second folded position for a less compact carriage with added stability requirements. The multiposition folding control surface comprises a spindle fitting which is attached to the missile, and which is rotatably controlled by a flight control actuator. A center fitting is hingedly attached to the spindle fitting, and provides a nonactuated folding of the center fitting to accommodate more compact missile storage in a shipping container. An actuator housing is hingedly attached to the center fitting, and provides the major aerodynamic surfaces for the control surface. An actuated hinged linkage is attached to the actuator housing, and has an anchor link, one end of which can be attached by a release pin to either the center fitting to provide the first folded position, or the actuator housing to provide the second folded position, depending upon which of the first and second fold positions is selected. A power actuator is provided for powering the actuated hinged linkage and uses the same power stroke to deploy the actuator housing from either of the first or second folded positions to a fully deployed and extended flight position.

In greater detail, the power actuator comprises a pyrotechnic linear actuator which includes a piston and cylinder. The power actuator includes an end slider connector which has a pivotal connection to one end of an actuator link. The second end of the actuator link has a pivotal connection to two separate elements, a secondary link and a pivot link. The pivot link is pivoted at its second end about a hinge fitting, and the second end of the secondary link is attached by a pivotal connection to a bellcrank. The bellcrank is pivoted about a central point thereof, and the second end of the bellcrank is attached by a pivotal connection to the anchor link. During operation, the actuator housing is pivoted about its hinge, and snap fits into and is secured in a fully deployed position by snap locks thereon which are engaged by corresponding resilient locking pins positioned in apertures in the center fitting. After removal of the missile from a shipping container, the center fitting is pivoted about its hinges, and snap fits into and is secured in a deployed position by snap locks on the spindle fitting which are engaged by corresponding resilient locking pins positioned in apertures in the center fitting. A frangible link is also provided to secure the control surface in the first or second folded position, and is broken upon actuation of the power actuator.

The multiposition folding control surface utilizes a horizontal surface with an active and a passive fold. The active fold can be folded in either a 60° position replacing large strakes or a 130° position replacing small strakes. The passive fold, just outboard of the wiping plane, allows the horizontal surface to be folded for shipping. This fold enables the missile to be shipped complete with no additional components requiring attachment when the shipping container is opened. When removed from the shipping container, the horizontal surface is simply rotated up and automatically locks into position ready for the active fold to be positioned for launch.

The active fold mechanism utilizes a pyrotechnic actuator to rotate the surface from either position through a series of links. The links allow both a constant actuator stroke and initial piston position for either the 60° or 130° fold. Moving the anchor link and a quick release pin allows parts of the linkage to be activated or deactivated. For the 130° position, the majority of the linkage is deactivated by disengaging the anchor link from the actuator housing and attaching it to the center fitting by the quick release pin. For the 60° position, the anchor link is attached to the actuator fitting thus engaging the entire linkage. The engaged linkage allows full stroke of the actuator even though the surface rotates less than half of the full 130° rotation.

BRIEF DESCRIPTION OF THE DRAWINGS

The foregoing objects and advantages of the present invention for a multiposition folding control surface providing for improved launch stability in missiles may be more readily understood by one skilled in the art with reference being had to the following detailed description of a preferred embodiment thereof, taken in conjunction with the accompanying drawings wherein like elements are designated by identical reference numerals throughout the several views, and in which.

DETAILED DESCRIPTION OF THE DRAWINGS

Figure 1:
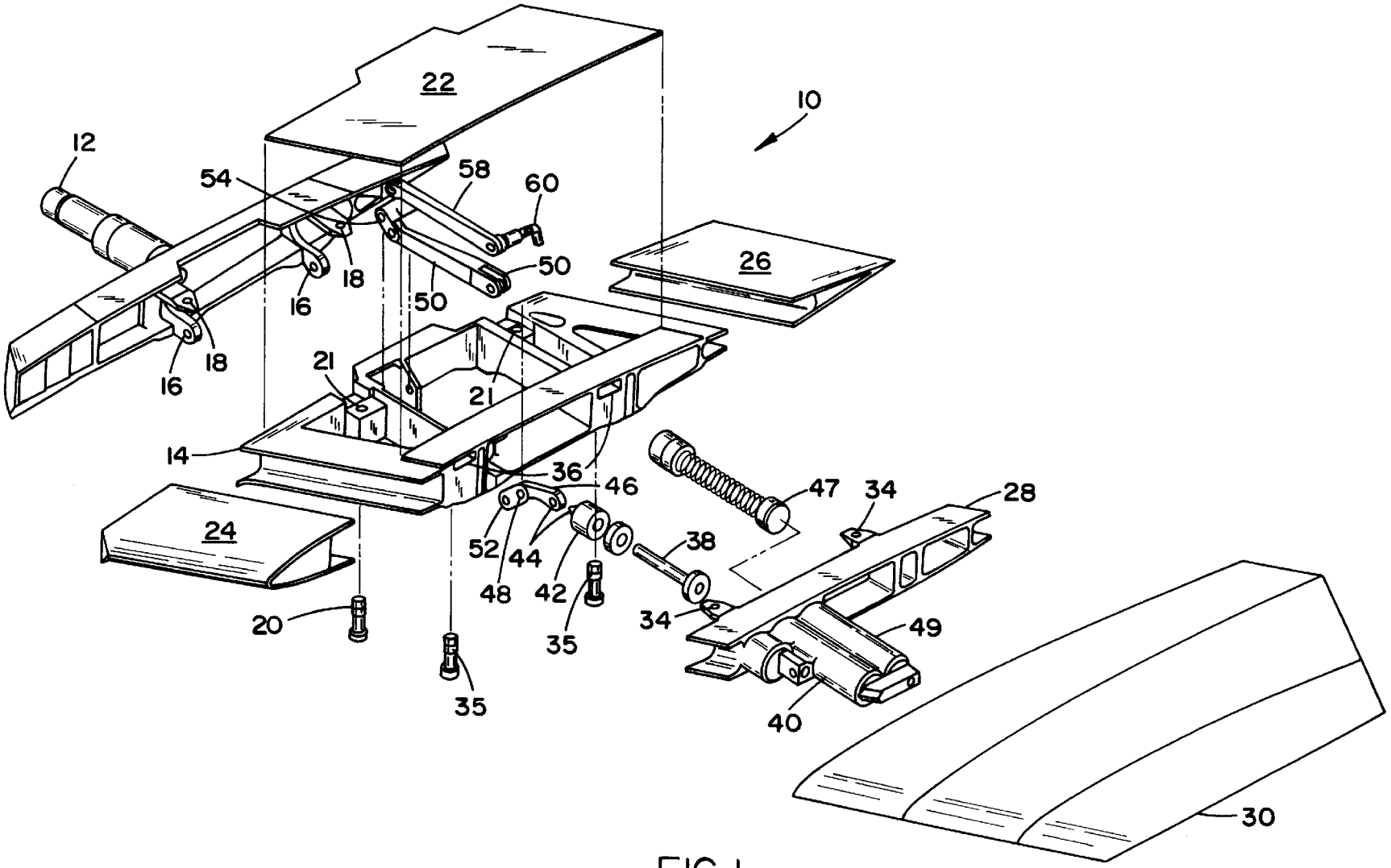
FIG. 1 is an exploded isometric view of the multiposition folding control surface of the present invention, showing the major control surfaces thereof, deployment linkage, surrounding support structure, hinges and deployment actuator.
Figure 2:
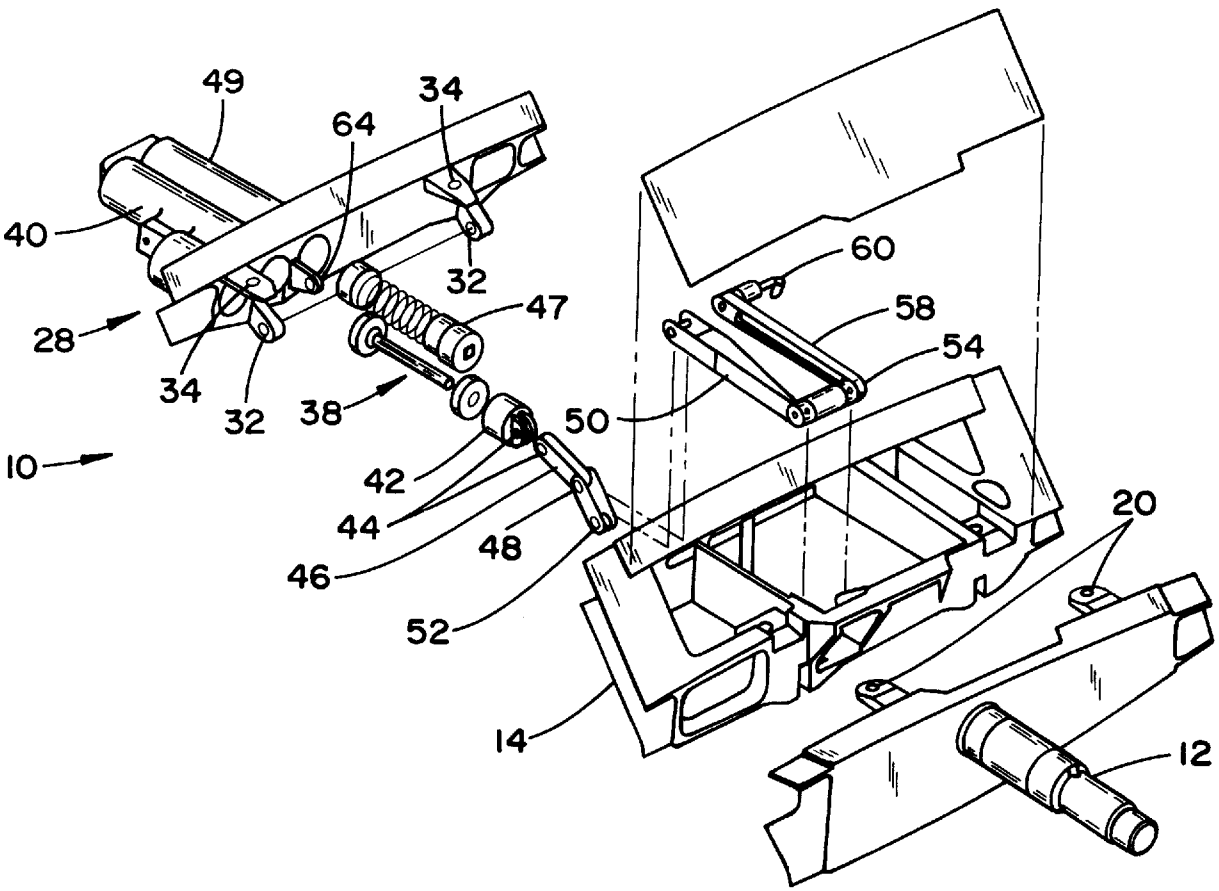
FIG. 2 is an exploded isometric view, reversed from FIG. 1, of the multi position folding control surface of the present invention, also showing the deployment linkage, surrounding support structure, hinges and deployment actuator.

Referring to the drawings in detail, FIG. 1 is an exploded isometric view of the multiposition folding control surface 10 of the present invention, showing the major control surfaces thereof, deployment linkage, surrounding support structure, hinges and deployment actuator, and FIG. 2 is an exploded isometric view, shown in a reverse direction from FIG. 1, of the same structural components. The structural components include a spindle fitting 12 which attaches to the missile and is rotatably controlled by a flight control actuator (not shown). The spindle fitting 12 is attached to a center fitting 14 by hinge pins at hinge pivot points 16. The hinge pivot points 16 are provided for a nonactuated folding hinge to accommodate more compact missile storage in a shipping container.

After removal of the missile from a shipping container, the center fitting 14 is pivoted upwardly (as illustrated in the Figures) about the hinge pin fittings at 16, and snap fits into and is secured in a deployed position by snap locks 18 which are engaged by corresponding resilient locking pins 20 positioned in apertures 21 on the center fitting 14. The center fitting 14 includes a top cover 22 and forward and aft center shell pieces 24 and 26 to provide the aerodynamic surfaces thereof.

The center fitting 14 is attached to an actuator housing 28 via a second actuated hinged linkage. An outboard shell 30 is attached to the actuator housing 28 and provides the major aerodynamic surfaces of the control surface. The actuator housing 28 is pivoted upwardly (as illustrated best in FIG. 2) about hinge pins at hinge pivot fittings 32, and snap fits into and is secured in the deployed position by snap locks 34 which are engaged by corresponding resilient locking pins 35 positioned in apertures at 36 (not visible but similar to apertures 21) on the center fitting 14. The actuator housing 28 is pivoted upwardly (as illustrated in the Figures) by the second actuated hinged linkage which forms the subject of the present invention, and snap fits into and is secured in the deployed position by the snap locks 34 which are engaged by the corresponding resilient locking pins 35 positioned in apertures at 36 on the center fitting 14.

Figure 3:
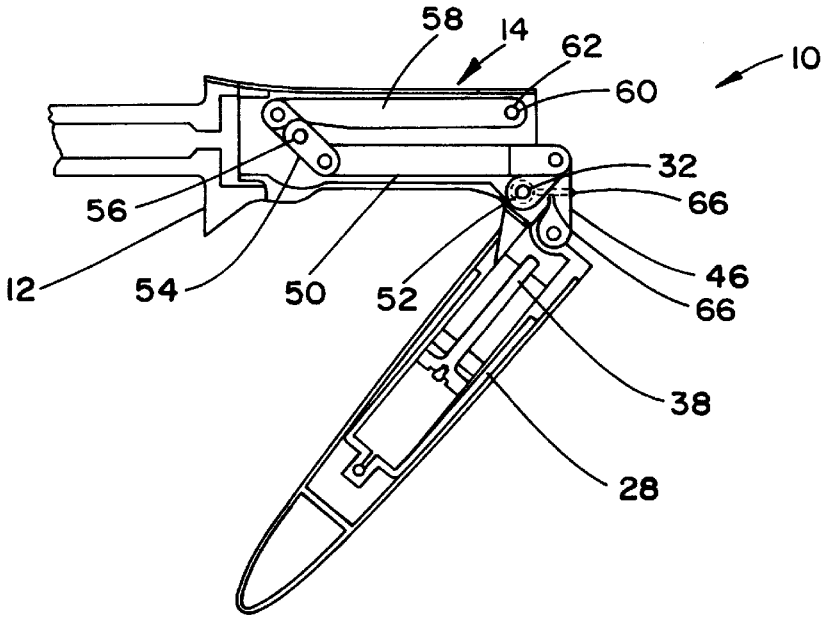
FIG. 3 is an elevational sectional view of the multiposition flight control surface in its most compact folded position, showing the deployment linkage in that compact folded position.
Figure 4:
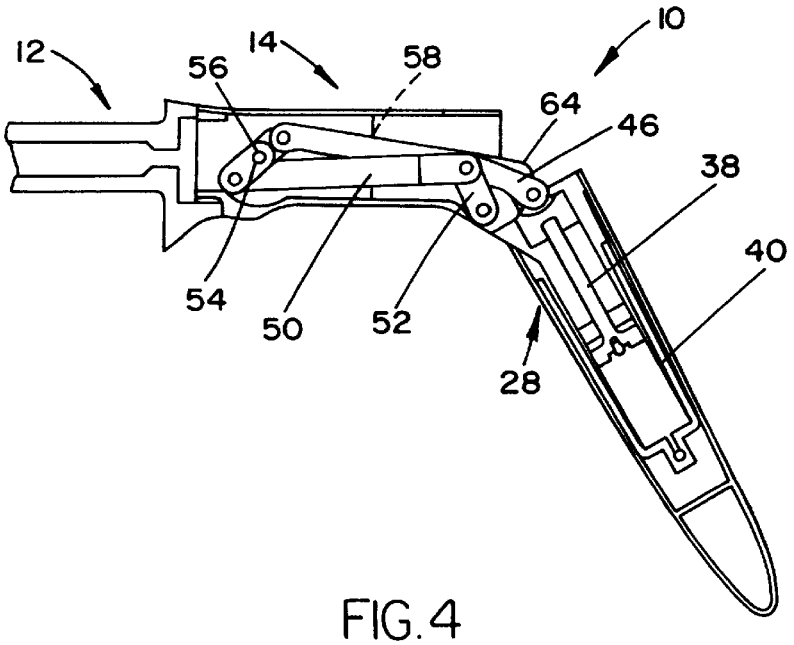
FIG. 4 is an elevational sectional view of the flight control surface in its larger tail span folded position, showing the deployment linkage in that larger tail span folded position.

The actuated hinge linkage of the present invention includes and is actuated by a pyrotechnic gas piston 38, normally positioned in a cylinder 40, which includes an end slider connector 42 which has a pivotal pin connection at 44 to one end of an actuator link 46. A shock absorbing piston 47 and cylinder assembly 49 is also positioned along side the pyrotechnic gas piston and cylinder 38, 40. As illustrated best in FIGS. 3 and 4, the second end of the actuator link 46 has a pivotal pin connection at 48 to two separate elements, a secondary link 50 and a pivot link 52. The pivot link 52 is pivoted at its second end about one of the hinge fittings 32. The other end of the secondary link 50 is in turn attached by a pivotal pin connection to a bellcrank 54 which is pivoted about a center pin at 56. The other end of the bellcrank 54 is attached by a pivotal pin connection to an anchor link 58. The other end of the anchor link 58 can be attached by a release pin assembly 60 to either the center fitting 14 at 62, as illustrated in FIG. 3, or the actuator housing 28 at 64, as illustrated in FIGS. 2 and 4, depending upon which fold position is required. A frangible link at 66 secures the control surface in the folded position, and is broken upon actuation of the gas piston 38.

Figure 5:
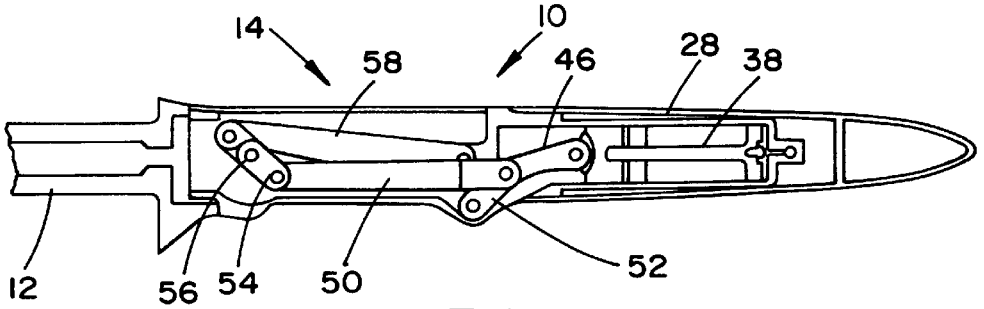
FIG. 5 is an elevational sectional view of the flight control surface in its deployed, fully extended flight position, showing the deployment linkage in that deployed flight position.

FIG. 3 illustrates the flight control surface 10 folded in its minimum span and therefore minimum stability position. The anchor link 58 is attached to the center fitting 14 via the quick release pin assembly 60 at 62, as illustrated in FIG. 3. In this case, the gas piston 38 pulls upon actuator link 46 which in turn acts upon pivot link 52 and secondary link 50. Secondary link 50 acts upon the bellcrank 54 which in turn acts upon the anchor link 58. Anchor link 28 is fixed to the center fitting 14, so in this case the components 50, 54 and 28 do not move. As gas piston 38 retracts, it acts upon the actuator link 46 which pivots about pivot link 52 and also causes the folded portion of the surface 10 to move to and lock in the fully deployed position illustrated in FIG. 5.

FIG. 4 shows the flight control surface 10 folded to its larger tail span position which offers greater stability. In this case, the anchor link 58 is attached to the actuator fitting 28 at 64 by the release pin assembly 60. The gas piston 38 attaches to the actuator link 46 which in turn attaches to both the pivot link 52 and the secondary link 50. The secondary link 50 attaches to the bellcrank 54 which in turn attaches to the anchor link 58. As the gas piston 38 retracts, actuator link 46 acts upon both the pivot link 52 and the secondary link 50. The secondary link 50 in turn acts upon the bellcrank 54 which in turn acts upon the anchor link 58. In this case, the anchor link 58 acts upon the actuator fitting 28 which in turn pulls the folded portion up to the fully deployed position shown in FIG. 5.

Figure 6:
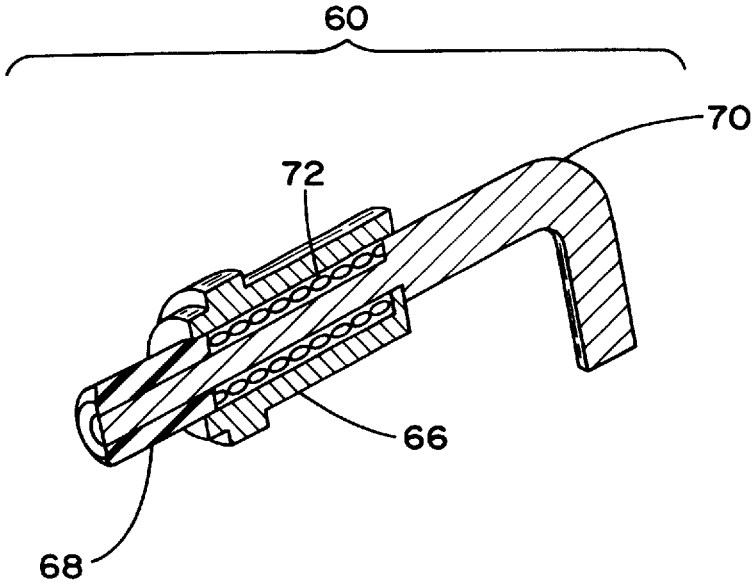
FIG. 6 illustrates an isometric sectional view of an exemplary quick release pin assembly.

FIG. 6 illustrates an isometric sectional view of an exemplary quick release pin assembly 60. An attach housing 66 threads into the anchor link 58. A pin shank 68 threads onto a handle 70 thus enclosing a retention spring 72. When handle 70 is pulled out, the pin shank 68 retracts, allowing the anchor link 58 to be repositioned.

While several embodiments and variations of the present invention for a multiposition folding control surface for improved launch stability in missiles are described in detail herein, it should be apparent that the disclosure and teachings of the present invention will suggest many alternative designs to those skilled in the art.

What is claimed is:

1. A multiposition folding control surface for missiles designed to provide improved launch stability therefor and which can be folded in one of two positions depending upon size and stability requirements, a first folded position for compact carriage with minimal stability requirements, and a second folded position for a less compact carriage with added stability requirements, comprising:

a. a spindle fitting which is attached to the missile and is rotatably controlled by a flight control actuator;

b. a center fitting attached by a hinge means to the spindle fitting and providing a nonactuated folding of the center fitting to accommodate more compact missile storage in a shipping container;

c. an actuator housing attached by a hinge means to the center fitting and providing the major aerodynamic surfaces for the control surface;

d. an actuated hinged linkage attached to the actuator housing and having an anchor link, wherein one end of the anchor link can be attached by a release pin to either the center fitting to provide the first folded position or the actuator housing to provide the second folded position, depending upon which of the first and second fold positions is selected; and e. a power actuator for actuating the actuated hinged linkage and using the same power stroke to deploy the actuator housing from either of the first and second folded positions to a fully deployed and extended flight position.

2. A multiposition folding control surface for missiles as claimed in claim 1, wherein the power actuator comprises a pyrotechnic linear actuator including a piston and cylinder.

3. A multiposition folding control surface for missiles as claimed in claim 2, wherein the power actuator includes an end slider connector which has a pivotal connection to one end of an actuator link, the second end of the actuator link has a pivotal connection to two separate elements, a secondary link and a pivot link, the pivot link is pivoted at its second end about a hinge fitting, the second end of the secondary link is attached by a pivotal connection to a bellcrank which is pivoted about a central point, and the second end of the bellcrank is attached by a pivotal connection to the anchor link.

4. A multiposition folding control surface for missiles as claimed in claim 3, wherein the actuator housing is pivoted about its hinge means, and snap fits into and is secured in a fully deployed position by snap locks thereon which are engaged by corresponding resilient locking pins positioned in apertures in the center fitting.

5. A multiposition folding control surface for missiles as claimed in claim 4, wherein after removal of the missile from a shipping container, the center fitting is pivoted about its hinge means, and snap fits into and is secured in a deployed position by snap locks on the spindle fitting which are engaged by corresponding resilient locking pins positioned in apertures in the center fitting.

6. A multiposition folding control surface for missiles as claimed in claim 5, wherein a frangible link secures the control surface in the first or second folded position, and is broken upon actuation of the power actuator.

7. A multiposition folding control surface for missiles as claimed in claim 2, wherein the power actuator includes an end slider connector which has a pivotal connection to one end of an actuator link, the second end of the actuator link has a pivotal connection to two separate elements, a secondary link and a pivot link, the pivot link is pivoted at its second end about a hinge fitting, the second end of the secondary link is attached by a pivotal connection to a bellcrank which is pivoted about a central point, and the second end of the bellcrank is attached by a pivotal connection to the anchor link.

8. A multiposition folding control surface for missiles as claimed in claim 3, wherein the actuator housing is pivoted about its hinge means, and snap fits into and is secured in a fully deployed position by snap locks thereon which are engaged by corresponding resilient locking pins positioned in apertures in the center fitting.

9. A multiposition folding control surface for missiles as claimed in claim 4, wherein after removal of the missile from a shipping container, the center fitting is pivoted about its hinge means, and snap fits into and is secured in a deployed position by snap locks on the spindle fitting which are engaged by corresponding resilient locking pins positioned in apertures in the center fitting.

10. A multiposition folding control surface for missiles as claimed in claim 5, wherein a frangible link secures the control surface in the first or second folded position, and is broken upon actuation of the power actuator.

* * * * *